US007416146B2

(12) United States Patent
Britzke

(10) Patent No.: US 7,416,146 B2
(45) Date of Patent: Aug. 26, 2008

(54) WEAR RESISTANT CENTER FEED IMPACT IMPELLER

(75) Inventor: Robert W. Britzke, Eureka Springs, AR (US)

(73) Assignee: Kennametal Inc., Latrobe, PA (US)

( * ) Notice: Subject to any disclaimer, the term of this patent is extended or adjusted under 35 U.S.C. 154(b) by 1179 days.

(21) Appl. No.: 09/921,430

(22) Filed: Aug. 2, 2001

(65) Prior Publication Data

US 2003/0025020 A1 Feb. 6, 2003

(51) Int. Cl.
*B02C 19/00* (2006.01)

(52) U.S. Cl. ..... 241/300; 241/275

(58) Field of Classification Search ..... 241/275, 241/294, 300

See application file for complete search history.

(56) References Cited

U.S. PATENT DOCUMENTS

| | | | | | |
|---|---|---|---|---|---|
| 3,058,679 | A | | 10/1962 | Adams | 241/275 |
| 3,150,838 | A | * | 9/1964 | Adams | 241/275 |
| 3,204,882 | A | * | 9/1965 | Vifian et al. | 241/275 |
| 3,578,254 | A | | 5/1971 | Wood | 241/275 |
| 3,955,767 | A | | 5/1976 | Hise | 241/275 |
| 4,090,673 | A | | 5/1978 | Ackers et al. | 241/275 |
| 4,390,136 | A | | 6/1983 | Burk | 241/275 |
| 4,690,341 | A | | 9/1987 | Hise et al. | 241/275 |
| 4,787,564 | A | * | 11/1988 | Tucker | 241/275 |
| 4,940,188 | A | * | 7/1990 | Rodriguez et al. | 241/275 |
| 5,029,761 | A | * | 7/1991 | Bechler | 241/275 |
| 5,203,513 | A | * | 4/1993 | Keller et al. | 241/235 |
| 5,921,484 | A | | 7/1999 | Smith et al. | 241/275 |
| 5,954,282 | A | | 9/1999 | Britzke et al. | 241/275 |
| 6,070,820 | A | | 6/2000 | Young et al. | 241/275 |
| 7,028,936 | B2 | * | 4/2006 | Condon | 241/275 |

FOREIGN PATENT DOCUMENTS

| | | | | |
|---|---|---|---|---|
| EP | 0276848 | * | 8/1988 | 241/275 |

OTHER PUBLICATIONS

PCT Search Report mailed Nov. 6, 2002, in countertpart application PCT/US02/23557, filed Jul. 25, 2002.

U.S. Appl. No. 09/340,680 to Britzke et al. filed Jun. 29, 1999, entitled "A Plate for Reducing Wear by a Material Flow".

* cited by examiner

*Primary Examiner*—Mark Rosenbaum
(74) *Attorney, Agent, or Firm*—Matthew W. Smith

(57) ABSTRACT

The present invention is particularly, but not exclusively, useful for reducing wear of component parts of impact crushers caused by earth aggregate flows during operation of impact crushers. The present invention includes a stepped central feed cone that allows for cylindrical carbide rods to be press fit therein to reduce wear. The downward steps of the stepped cone urge material fed to the stepped cone outwardly to the table. The top surface of a first rod inserted into a first bore formed in the impeller housing extends a distance beyond the bottom of a second bore on the next step up. The first rod protects the housing material forming the second bore from being washed out by material flow. In one embodiment, the impeller shoes have a geometric shape that reduces excessive normal forces and accompanying high friction of the material against the shoe. The reduction in high friction significantly reduces the wear rate.

7 Claims, 3 Drawing Sheets

WEAR RESISTANT CENTER FEED IMPACT IMPELLER

FIELD OF THE INVENTION

The present invention pertains to a plate for reducing wear of components of an impact crusher caused by an aggregate flow. The present invention is particularly, but not exclusively, useful for reducing wear of component parts of impact crushers caused by earth aggregate flows during operation of impact crushers.

BACKGROUND OF THE INVENTION

Regardless of the precise nature or function of an apparatus in which components are subjected to wear by a material flow, wear causes need for repair and replacement of components and delays in use of the apparatus while one or more worn components is identified, inspected, removed, and replaced. Wear of components adds to the expense of maintaining and operating the apparatus. Such delays, costs, and expenses are compounded if the apparatus in which wear occurs is located at a remote site.

For example, a wide variety of impact crushers are used in commerce to reduce the size of larger earth materials to smaller sized aggregate. The construction industry trades employ a variety of impact crushers to reduce large aggregate to aggregate sizes and shapes required to satisfy construction specifications for mixtures and admixtures of aggregate with cement and other ingredients and for further processing of size reductions, chemical leaching, and other stages of use. The construction industry's use of impact crushers is but one example of the need to reduce wear caused by a materials flow in an apparatus used to effect the size of particles in the materials flow, to make substantially uniform the size of particles in a materials flow, and to prepare materials for further processing.

Generally, impact crushers provide a device for introducing aggregate into a device for crushing the aggregate. Most impact crushers are designed to rely on centrifugal force to disperse large aggregates through the crusher and to impact the aggregate against a wide variety of impact crusher components to break up, reduce in size, and ultimately eject from the crusher, aggregates composed of desired shapes, sizes, and consistency. Intense efforts have been devoted to improvements in the design and construction of components of impact crushers to reduce the cost of acquiring and operating crushers, to enhance wear resistance of the component parts of crushers, and to facilitate rapid replacement of worn parts of crushers to enable the user of crushers to lose the least possible amount of time during which a crusher is inoperative due to worn parts.

Such improvements are exemplified by those shown in U.S. Pat. No. 3,955,767 issued May 11, 1976 and U.S. Pat. No. 4,690,341 issued Sep. 1, 1987. The Hise Patents are instructive on the number and variety of components which may be included in an impact crusher and consequently exposed to wear during operation of an impact crusher. All components of an impact crusher exposed to a material flow of aggregate, as exemplified in the Hise Patents and other impact crushers, are subject to abrasion, decomposition, fracture, friction, impact, pulsation, wave action, grinding, and other actions causing wear to components of an impact crusher is due to the velocity, acceleration and composition of aggregate flows against, across, and around the components during operation of a crusher (collectively, "wear"). For example, an impeller of an impact crusher may receive and hurl aggregate against one or more crusher components generally known in the art as anvils. An impeller of an impact crusher is known to rotate at speeds from about 500 to about 2000 RPM. The rotation of an impeller, in combination with centrifugal force, creates a material flow of aggregate consisting of a variety of sizes and shapes of aggregate being projected at, over, and around many of the components of the crusher. It is significant that persistent wear occurs not just on anvils, which are designed to cooperate with other crusher components in crushing aggregate, but also on any other component of an impact crusher which may be exposed to the aggregate flow during operation of the crusher.

As a result of persistent wear caused by material flows, components of crushers must be replaced. Replacement of components causes "down time" to repair, refit, and replace components. Additional expenses are associated with replacing the worn part or component, inventorying replacement components, and delivering a replacement component to what is often a remote site.

An impeller may include but is not limited to one or more impeller tables, one or more impeller covers, and brackets holding and connecting the tables and covers. An impact crusher may be designed to use shoes attached to an impeller assembly. The shoes, in combination with centrifugal force, hurl and direct an aggregate flow generated by operation of an impeller assembly against one or more anvils located within the crusher.

The face of the prior art shoes are radially oriented with respect to the central axis of the impellers. The impeller shoes change the direction of the material flowing outwardly along the impeller table due to centrifugal force. The accelerating mass of the material applies a substantial force vector normal to the surface of the shoe. The normal force against the surface of the shoe results in high friction and high wear rates of the shoe.

The table section adjacent the shoes are also exposed to continual material flow and, therefore, higher wear rates than the remainder of the table. Further, the central feed section of impact crushers are subjected to higher wear rates.

U.S. Pat. No. 5,954,282 to Britzke et al. discloses an impeller assembly having wear rods made from a hard material press fit into bores formed in the vertical crusher assembly. Such impeller designs with wear resistant rods in the prior art have a flat central feed disc for receiving vertical material flow. Vertical impact crushers such as U.S. Pat. No. 5,954,282 incorporate a flat central feed disc for receiving material from a hopper. Such a design has limited use with respect to the selection of materials that can be employed with the impact crusher. For instance, finer materials such as lime are not adequately fed to the impeller shoes so as to permit proper propulsion of the lime by the shoes against the anvils for disintegration of the lime material.

In U.S. Pat. No. 5,954,282, the matrix of bores are disclosed as being equidistant from axes through the center of the bores. Such insert rod patterns did not take into consideration areas of impeller assemblies that are more prone to wear because they are subject to greater material flow, material flow forces, and material flow loads.

Ackers et al. U.S. Pat. No. 4,090,673 discloses a centrifugal impact rock crusher having a central feed area with a central feed cone. The central feed area is subject to large impact forces that may arise when rock is fed from the central hopper to the centrifugal impact crusher. Feed cones made from a uniform steel alloy as disclosed in U.S. Pat. No. 4,090,673 must be frequently replaced.

What is needed, therefore, is a device for reducing wear of components of apparatus exposed during operation to a material flow. Particularly, what is needed is a device for reducing wear of components of an impact aggregate crusher caused by a material flow of aggregate during operation.

It is an object of the present invention to provide an impact crusher assembly when exposed to material flows during operation of the impact crusher that will increase the wear life of components by resisting wear caused by a material flow across, over, and around the impact crusher assembly.

Still, another object of the present invention is to provide a design for reducing wear of components of impact crushers during operation and a method for manufacturing wear reducing components which are easy to manufacture, use and to practice and which are cost effective for their intended purposes.

These and other objects, features, and advantages of such components for reducing wear by a material flow will become apparent to those skilled in the art when read in conjunction with the accompanying following detailed description, drawing figures, and appended claims.

SUMMARY OF THE INVENTION

An impeller assembly for reducing wear is caused by a material flow. The impeller assembly includes one or more impeller tables, one or more impeller covers attached to the impeller tables, and brackets holding and interconnecting the tables and covers. The impeller assembly assists in projecting and directing an aggregate flow against, over or around another embodiment of a body (e.g. anvil) designed for crushing, fracturing, breaking up and reducing in size and shape large aggregate into smaller sizes and shapes.

The present invention includes a stepped central feed cone that allows for cylindrical carbide rods to be press fit therein to reduce wear. The downward steps of the stepped cone urge material fed to the stepped cone outwardly to the table.

An improved wear resistant impeller wherein the central feed disc has a stepped conical shape to enable the impact crusher to be effectively employed in disintegrating a larger variety of material types shapes and sizes. It is believed that the stepped cone reduces material accumulating within the impeller and slowing down the feed rate and crushing process.

In the present invention, the outer end of a first rod inserted into a first bore formed in the impeller housing may extend a distance beyond the bottom of a second bore adjacent the first bore. The first rod protects the housing material forming the second bore from being worn away by material flow, "washed out." The housing material is typically made from a softer ferrous material than the insert rods from cemented tungsten carbide, for instance. The housing that forms the insert receiving bores erodes quicker than the insert rods. Each rod in the applicant's invention is positioned to prevent adjacent rods from being "washed out."

In the present invention, the impeller shoes have a geometric shape that reduces excessive normal forces and accompanying high friction of the material against the shoe. The reduction in high friction significantly reduces the wear rate.

On the exposed peripheral surface of the conical center feed section, a plurality of elongated insert rods made from hard material are attached to protect the peripheral side surface of giant step of the center feed section from undercutting wear caused by material flow rebounding off anvils and shoes back toward the center of the rock crusher. The present invention also has rod inserts positioned about the outer periphery of the center feed disc and table for protecting the periphery from wear.

The novel features of this invention and the invention itself, both in structure and operation, are best understood from the accompanying drawing considered in connection with the accompanying description of the drawings.

DESCRIPTION OF THE PREFERRED EMBODIMENTS

U.S. Pat. No. 5,954,282 to Britzke et al. issued on Sep. 21, 1999 is incorporated by reference herein in its entirety.

Figure 1:
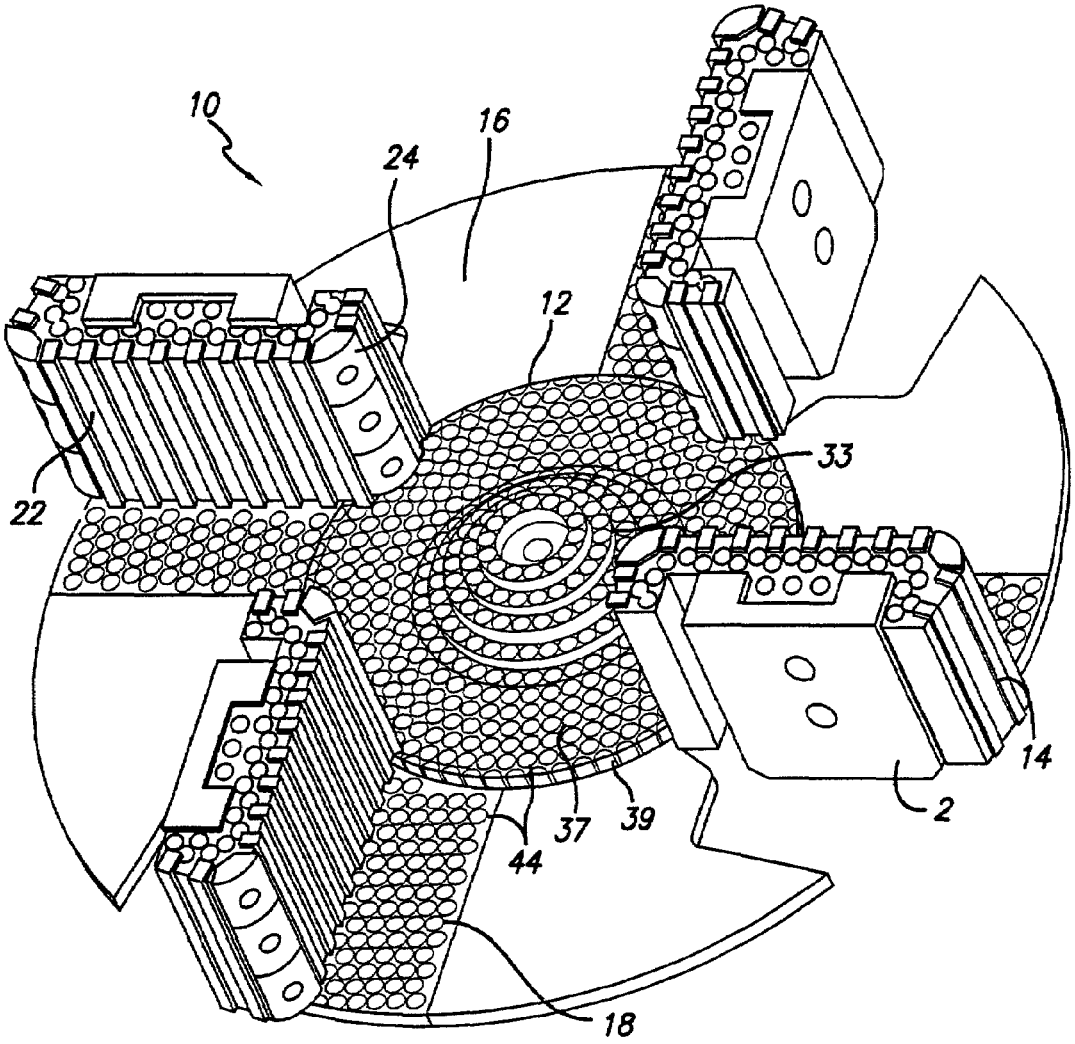
FIG. 1 is a perspective view of a component of an impact crusher showing an impeller plate for reducing wear by a material flow in an operative environment.

Referring initially to FIG. 1, a vertical impact crusher for reducing wear by a material flow, according to the present invention, is shown and generally designated 10. As shown, impact impeller assembly 10 includes rod inserts made from a hard material for reducing wear by a material flow. The impact impeller includes a central stepped feed body 12, impeller shoes 14, an impeller table 16, shoe liners 18 attached to impeller table 16, and brackets 20 holding and interconnecting table 16 and shoes 14.

The shoe liners 18 and shoes 14 are pre-assembled together and then may be attached to impeller table 16 to assist in projecting and directing an aggregate flow against, over, or around an anvil (not shown) of an impact crusher for crushing, fracturing, breaking up, and reducing in size and shape large aggregate into smaller sizes and shapes. Similarly, the central feed body 12 is constructed and then connected to the table 16.

The shoe liners 18 and central feed body 12 have a plurality of bores 34 formed therein for receiving a wear resistant rod which may be exposed to a material flow during operation of an impact aggregate crusher. Neither the shape nor any dimension of the bores 34 is significant to the present invention. The bores 34 may be formed in body 12, by a variety of techniques well known in the art, including drilling, reaming, countersinking, or incision by thermal means. The steps of the stepped central feed body provide for flat landing top surfaces that are beneficial in drilling bores as the drill is not as prone to "walking" which would occur if bores where to be drilled on the surface of a central conical feed body as in U.S. Pat. No. 4,090,673 to Ackerset et al. Each bore 34 has an opening at its upper end and a closed bottom 31.

Figure 3:
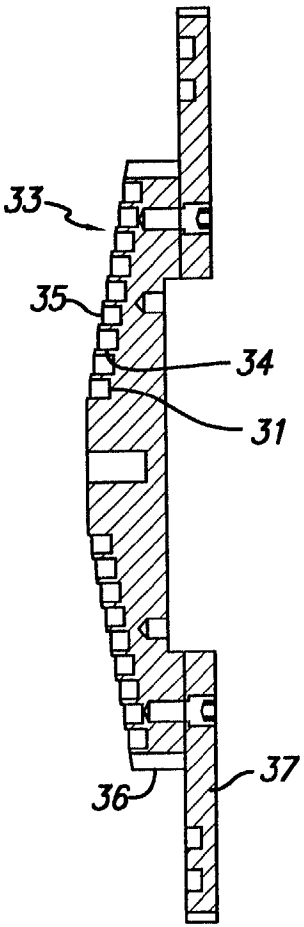
FIG. 3 is a cross-sectional view of a central feed body shown in FIG. 2.
Figure 2:
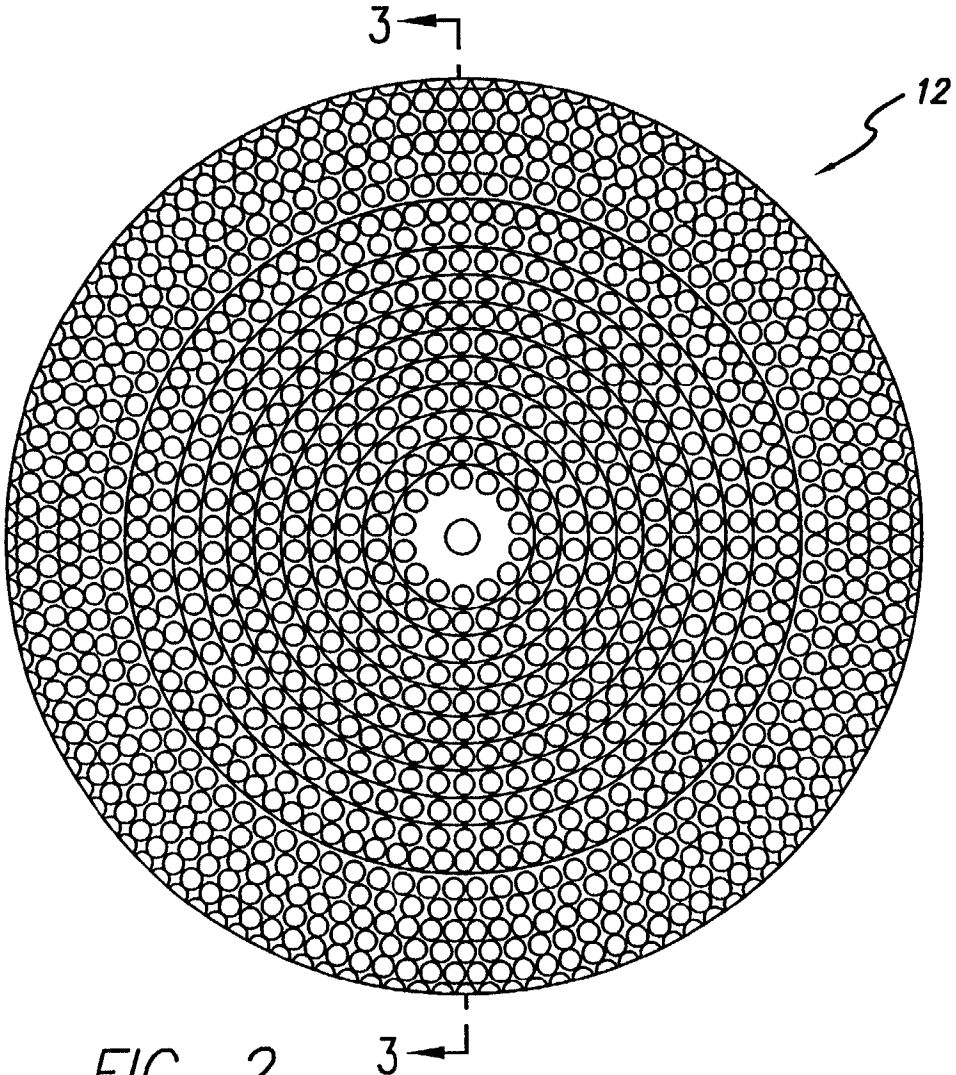
FIG. 2 is a top view of the stepped central feed body shown in FIG. 1.

The pattern of bores 34 shown in FIG. 3 is merely one embodiment of a pattern of bores. It is not intended to be exclusive and is not a limitation of the present invention. The pattern of bores and insert rods 44 for the central feed body, can be a plurality of concentric circles wherein adjacent circles have inserts centrally positioned at half the distance between adjacent inserts on the adjoining concentric circle to minimize the number of inserts needed to protect the impeller parts from material flow. On the shoe and shoe liner the inserts are aligned in rows and equally spaced apart within each row. Adjacent rows can be staggered with the inserts centrally positioned at half the distance between adjacent inserts on rows immediately adjacent thereto.

The central feed body portion includes a plurality of elevated concentric steps 33 having an overall generally frustoconical shape and a concentric annular ring 37. At the very outer periphery 38 of the stepped center feed where the stepped center feed body adjoins the impeller table 16, the stepped center feed is elevated above the table 16 forming a step. Thus, the entire stepped central feed body is elevated above the table including the shoe liners. This elevation of the stepped central feed body helps to limit wear of the table and shoe liner. Each consecutive step inward towards the center of the impeller is higher than the last so that the flow of material is not inhibited by any surfaces or structure that act as an obstacle to flow in the radial direction. In addition, material on the conical steps is urged downward and radially outward by gravitational forces. The gravitational force thereby assists in accelerating the material out from the impeller.

Each step 33 includes a plurality of equally spaced bores having insert rods pressed therein. The top surface of the rods are flush with the top surface of the housing step 33 on which they are positioned. The top surface 35 of each insert rod is positioned significantly higher than the bottom end 31 of an insert bore on the next adjoining higher step. The positioning of the top surface of the rod significantly above the bottom end of an adjoining rod inhibits material from being "washed out" from around the bottom ends of the next adjoining insert rods. Each insert rod protects adjacent rods from being "washed out." "Washed out" insert rods can cause catastrophic destruction of the impeller assembly when they become dislocated and accelerated against other impact crusher elements.

An annular concentric ring 37 surrounds the central stepped feed cone and the periphery of the concentric ring abuts the annular table 16. The concentric ring (37 peripheral side) is positioned above the top surface of the table 16 forming an elevated step 39 there between. This step is for the purpose of preventing material flow from impacting against the inner peripheral sidewall surface of the table 16. The step 39 height is designed to be sufficient to ensure that the concentric ring 37 is not displaced downward under the weight of material below the inner peripheral sidewall of the table. If the inner peripheral sidewall of the table became elevated above the concentric ring 37, then the material flow would quickly washout the sidewall of the table.

Centrifugal force urges the rock material outwardly from the feed cone. The rock material continues to slide radially outward as well as sliding circumferencially against the direction of impeller table rotation. Thus rock builds up against the shoes 14 where it continues to be directed radially outward to strike anvils. Thus, the heaviest wear and abrasion occurs at the bottom inner portion of the shoes and on the liner 18 adjacent the shoe.

Figure 4:
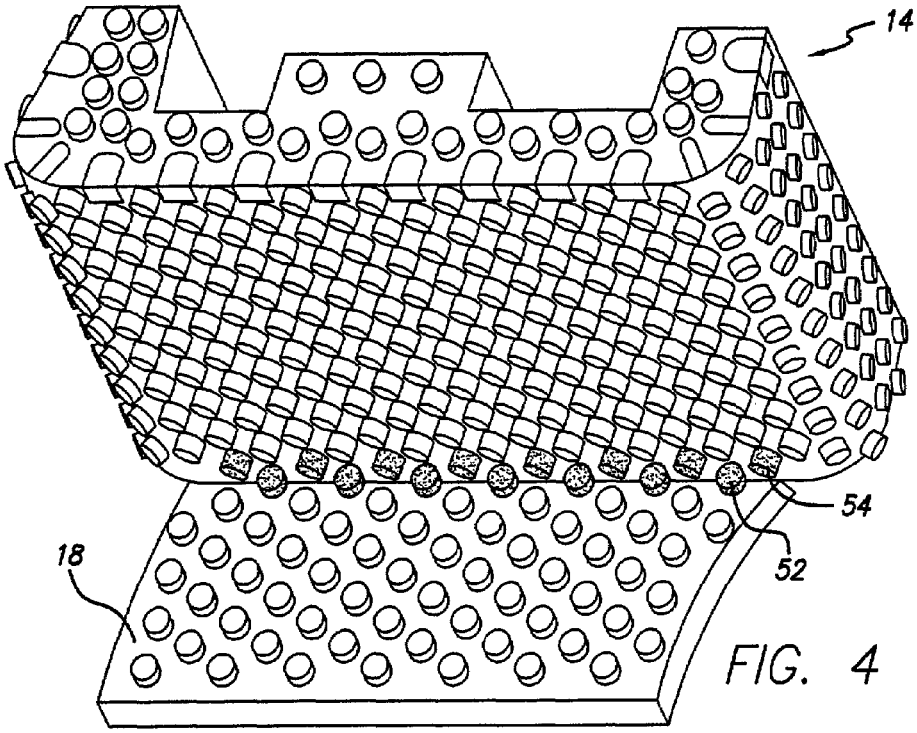
FIG. 4 is a cross-sectional view of another alternative embodiment of a shoe and liner for reducing wear by a material flow.

In the prior art, significant wear occurs adjacent the crease formed between the shoe liner and shoe. In the embodiment illustrated in FIG. 4, the insert rods are aligned so as to be "stitched" together. Each rod on the bottom row of the shoe 54 centrally extends into the space formed between adjacent rods 52 in the last row (near the vertical shoe) of the rods on the shoe liner and visa versa. This stitch significantly reduces the heavy wear in the crease that had existed in prior art impellers.

In the prior art, the peripheral side surface of tables and the exposed peripheral surfaces of other members often suffer from excessive wear resulting from flow material ricocheting and rebounding off of anvils and other elements back toward the center of the impeller. The first peripheral surface formed at the giant step between the bottom step of the concentric step 33 and the concentric ring 37 of the stepped central feed 12 has a plurality of elongated insert rods 36 extending from the bottom of the giant step to the top landing of the giant step. Additionally, elongated insert rods 36, as shown in FIG. 1, are positioned between the central feed section 12 and table 16 to protect these surfaces from ricocheting material. These rods are fixed to the peripheral surface by brazing.

Figure 5:
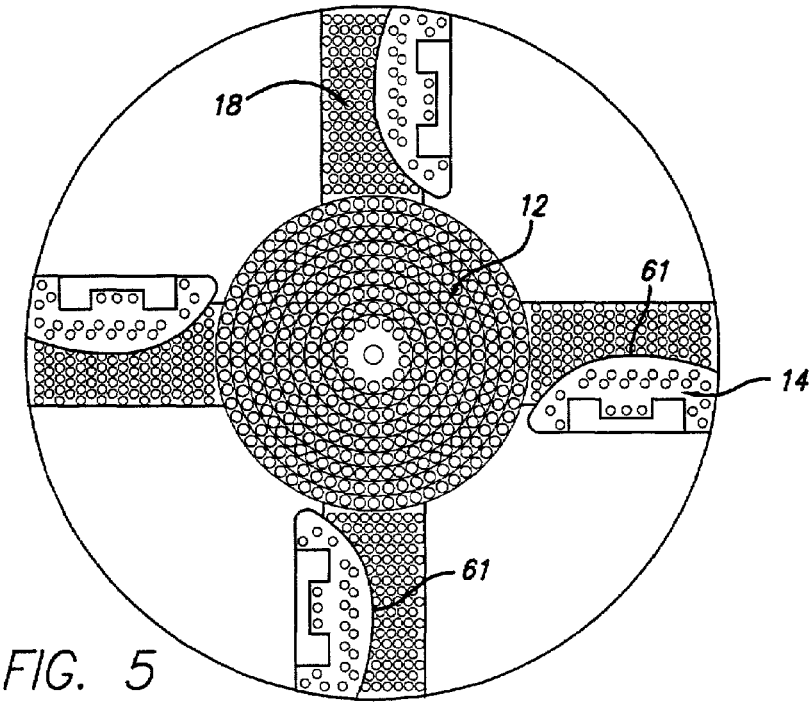
FIG. 5 is a top view of a third embodiment of an impeller assembly of an impact crusher.

As seen in FIG. 5, the front face 61 of the shoe 14 is not radially oriented along a radii R-R but is curved to more closely approximate the free flow path of material across the impeller table. Prior art impeller shoes generally have planar surfaces that are oriented radially with respect to the impeller central axis. Such a radial orientation subjects sections of the shoe to high normal force loads from the material sliding against the rotation of the table and accompanying high friction of the material against the shoe. The reduction in high friction significantly reduces wear. The front face of the shoe that contacts the material in the applicant's invention has geometry other than a plane surface along the radii of the impeller.

The front material contact face 61 of the shoe 14 is curved forward similar to a convex surface. The shoe's front face more closely approximates the free flow path of material as material would flow across the impeller table without shoes. The calculation or experimental determination of the material aggregate flow path across an impeller table without shoes is well known in the art. Once the free path of the materials is determined, a shoe front face can be designed only to slightly interfere with the free flow path thereby uniformly distributing and minimizing normal and frictional forces. The front face of the shoe accelerates the material into anvils for disintegration but the normal forces applied to the shoe front face are more evenly distributed as material flows across the front face. In the applicant's design, there are no sections of the front face where the normal force load is applied. Further, no sections are subjected to forces disproportionately greater than the forces applied to other sections such as on the radial planer shoe faces of the prior art.

Bottom ends of rods 44 used in the disclosed embodiments are designed to be secured immovably in bores 34. The rods may be press fit into the bores or the rods 44 may be provided with threads that cooperate with the inner surface of the bores 34. As shown in FIG. 3, the top end surface 35 of one or more rods 44 may extend a distance above the opening end of the bore.

To achieve the objects of the present invention, the bottom end of the rods 44 are inserted into the bores 34 to position top end surface 35 of rods 44 a distance beyond the opening of the bores. The distance the top end surface 35 extends beyond an opening is not fixed or uniform and is not a limitation of the present invention. The distance each rod extends above a bore 34 exposed to a material flow, need not be uniform in accordance with the present invention. The capacity of plate 10, according to the present invention, to reduce wear by a material flow is not solely affected by the dimension that the top end surface of the insert rods extends beyond the bore. The effectiveness of the impeller assembly to reduce wear by a material flow, according to the present invention, is a function in part of the distance that the top surface extends beyond the opening of the bore as well as the design, shape, configuration, and location of the insert rods in relation to angles of incidence of a material flow against, over, and around the impeller and the alloy composition of rod 44.

The impeller shoes shown in the FIG. 1 embodiment illustrate a plurality of uniformly spaced vertical bars 22 brazed thereto that extend from the bottom of each shoe to the top surface of each shoe. The bars are only positioned along each wall of the impeller that contacts the material flow. The impeller shoes have a plurality of wedges 24 made of cemented tungsten carbide to protect corner areas which are most susceptible to wear. The wedges are bolted to the steel housing of the impeller shoe. The bolt is sunken in the wedge 24 and covered with cemented tungsten carbide for protection.

The insert rods and bars are manufactured by powder metallurgy techniques. However, manufacture of one or more rods 44 by powder metallurgy techniques is merely one embodiment of rod 44 in connection with the present invention. It is not intended to be exclusive, and it is not a limitation of the present invention. Thus, rod 44 may be manufactured by combining a powder such as tungsten carbide with a binder such as cobalt, nickel, or other similar chemical compositions. The powder and binder may be blended and compacted in a press or similar device. The resulting compacts provided by pressing the powder and binder may be sintered in substantially a vacuum at temperatures from about 1300 degrees Centigrade to 1500 degrees Centigrade, in an atmosphere composed typically of hydrogen, argon, and other gases.

The body of the shoe 14, shoe liner 18, table 16, bracket 20, and stepped central feed body 12, except for the rods 44, are composed primarily of ferrous materials. However, use of a ferrous material is merely one embodiment of the materials that may be used to compose these components; it is not intended to be exclusive and is not a limitation of the present invention.

While the particular plate for reducing wear of a material flow is fully capable of obtaining the objects and providing the advantages stated as shown and disclosed in detail in this instrument, this disclosure is merely illustrative of the presently preferred embodiments of the invention and no limitations are intended in connection with the details of construction, design, or composition other than as provided and described in the appended claims.

What is claimed is:

1. An impeller for hurling aggregate material toward anvils said impeller comprising:

a table comprising a support plate; and a frustoconical center feed body attached to said support plate, said center feed body comprising a plurality of concentric steps, containing a plurality of insert rods positioned in a plurality of bores formed in a top landing surface of each said step, said bores each having a bottom, wherein a top surface of each said insert rod is positioned significantly above an adjacent one of said bore bottoms up on the next said step, whereby said insert rod top surface protects insert rods up on the next step from being washed out.

2. The impeller according to claim 1 further comprising:

a shoe connected by a support bracket to said table; and a liner connected to said shoe and said table.

3. The impeller according to claim 2 wherein a bottom row of said insert rods are fixed to said shoe and a row of insert rods are fixed to said liner adjacent to said shoe, and said rows are stitched to protect a corner interface between said shoe and said liner.

4. A frustoconical center feed body for an impeller assembly comprising:

a plurality of concentric steps containing a plurality of insert rods positioned in a plurality of bores formed in a top landing surface of each said step, said bores each have a bottom, wherein a top surface of each said insert rod is positioned significantly above an adjacent one of said bore bottoms un on the next said step, whereby said insert rod top surface protects insert rods up on the next step from being washed out.

5. The center feed body according to claim 4 wherein extended insert rods are fixed to an exposed peripheral side surface of at least one of said step sections.

6. The center feed body according to claim 4 wherein said step sections each have a top landing surface that is generally horizontal with bores formed therein, said bores have a ventral axis that is generally perpendicular to each said horizontal surfaces.

7. An impeller for hurling aggregate material toward anvils said impeller comprising:

a table;

a center feed body;

a shoe connected by a support bracket to said table; and a shoe liner connected to said shoe and said table, wherein a row of insert rods are fixed to said shoe and a row of insert rods are fixed on said liner adjacent to said shoe, and said rows are stitched to protect a corner crease between said shoe and said liner.

* * * * *